US006430745B2

(12) United States Patent
Murai

(10) Patent No.: US 6,430,745 B2
(45) Date of Patent: Aug. 13, 2002

(54) LINING ELEMENT FOR BASEBALL GLOVE AND BASEBALL GLOVE IN WHICH THIS LINING ELEMENT IS USED

(75) Inventor: Hideaki Murai, Osaka (JP)

(73) Assignee: KSK Co., Ltd., Akune (JP)

( * ) Notice: Subject to any disclaimer, the term of this patent is extended or adjusted under 35 U.S.C. 154(b) by 0 days.

(21) Appl. No.: 09/775,553

(22) Filed: Feb. 5, 2001

(30) Foreign Application Priority Data

Mar. 24, 2000 (JP) ..... 2000-083100
Oct. 5, 2000 (JP) ..... 2000-305637

(51) Int. Cl.[7] ..... A41D 13/08
(52) U.S. Cl. ..... 2/19
(58) Field of Search ..... 2/19, 161.1, 164, 2/169, 159, 160, 161.6, 166; 473/464

(56) References Cited

U.S. PATENT DOCUMENTS 3,098,234 A * 7/1963 Latina ..... 2/19
3,576,036 A * 4/1971 Latina ..... 2/19
4,928,320 A * 5/1990 Aoki ..... 2/19
5,321,853 A * 6/1994 Onley ..... 2/19
5,974,587 A * 11/1999 Murai ..... 2/19

* cited by examiner

*Primary Examiner*—Danny Worrell
*Assistant Examiner*—Gary L. Welch
(74) *Attorney, Agent, or Firm*—Armstrong, Westerman, & Hattori, LLP

(57) ABSTRACT

The present invention is aimed at providing a lining element for a baseball glove and a baseball glove in which this lining element is used so that the bottom end portions of the thumb glove element and of the index finger glove element of the outer glove element cannot tear due to the impact when a ball is caught. Furthermore the present invention provides a lining element for a baseball glove, which is hand-shaped and comprises a front sheet to which finger parts are provided so as to extend from the bottom end portion, and a back sheet which is positioned on the back of the respective finger parts of the front sheet and forms the finger glove elements, wherein a fitting portion having through-holes for passing through a lace is provided between the thumb and index finger glove elements of said lining element.

7 Claims, 15 Drawing Sheets

LINING ELEMENT FOR BASEBALL GLOVE AND BASEBALL GLOVE IN WHICH THIS LINING ELEMENT IS USED

BACKGROUND OF THE INVENTION

1. Field of the Invention

The present invention relates to a lining element for a baseball glove which does not cause the ball catching surface to lose its shape and to a baseball glove in which this lining element is used.

2. Description of the Related Art

Conventional baseball gloves 101 are constituted, as shown in FIG. 15, from a lining element 102 and an outer glove element 103 and this lining element 102 is, as shown in FIG. 16, hand-shaped and comprises a front sheet 104 which can be fitted onto the palm of the hand, and a back sheet 105 which is positioned on the back of the respective finger part of said front sheet 104 and forms the respective finger glove element, while the glove shape is formed by positioning the front sheet 104 and the back sheet 105 one on top of the other, and stitching together the edges of the front sheet 104 and those of the back sheet 105, and through-holes 106 are provided in the bottom end part of the little finger glove element and thumb glove element and front sheet 104. Then, as shown in FIG. 15, the baseball glove 101 is assembled by incorporating the lining element 102 into the outer glove element 103 and by inserting and threading the laces 107 from the outer glove element 103 through the lining element 102.

However, in the conventional baseball glove 101, there is the problem that, as a result of the ball catching surface of the glove receiving impacts from the ball, in particular the leather between the thumb glove element and the index finger glove element, the so-called pocket of the ball catching surface, becomes stretched and as a result of this, it is not possible to maintain the adhesion between the outer glove element 103 and the lining element 102 so that the glove loses its shape and it becomes difficult to catch a ball with the glove. In addition, there is the problem that due to the impact when a ball is caught tearing incurs at the bottom end portions of the thumb glove element of the outer glove element 103 and of the index finger glove element of the outer glove element 103.

SUMMARY OF THE INVENTION

The present invention is aimed at overcoming these problems and provides a lining element for a baseball glove and a baseball glove in which this lining element is used, in which, even if the glove is subjected to heavy use, the pocket of the ball catching surface does not become stretched nor does the glove lose its shape so that it continues to be easy to catch a ball with the glove indefinitely and furthermore the bottom end portions of the thumb glove element and of the index finger glove element of the outer glove element cannot tear due to the impact when a ball is caught.

In order to achieve the above objects, a lining element for a baseball glove is provided which is hand shaped and comprises a front sheet to which finger parts are provided so as to extend from the bottom end portion, and a back sheet which is positioned on the back of the respective finger parts of the front sheet and forms the finger glove elements, and which is characterized in that a fitting portion having through-holes for passing through a lace is provided between the thumb glove element and index finger glove element of said lining element. At the same time, a baseball glove is provided which is characterized in that is used therein a lining element which is hand-shaped and comprises a front sheet to which finger parts are provided so as to extend from the bottom end portion, and a back sheet which is positioned on the back of the respective finger parts of the front sheet and forms the finger glove elements, and in which lining element a fitting portion having through-holes for passing through a lace is provided between the thumb element and index finger element, and that when the baseball glove is assembled by inserting and incorporating the lining element into the outer glove element by passing the lace from the outer glove element to the lining element, the lace is also passed through the through-holes in the lining element.

The inner element of the baseball glove is preferably provided with a fitting portion extension which is formed by providing a securing part which projects from the edge of the bottom end between the thumb and index finger parts of the front sheet and by forming through-holes in the securing part for passing through the lace.

In addition, in the lining element of a baseball glove, the fitting portion extension can also be formed by providing a securing part which is formed by extending a part of the back sheet positioned on the back of the thumb and index finger parts of the front sheet so as to project outward from the edge of the bottom end between the thumb and index finger parts of said front sheet, and forming through-holes for passing through a lace in this securing part.

Furthermore, in the baseball glove, securing through-holes which penetrate the surface side and the back side are preferably provided in the bottom end portion of the thumb glove element of the outer glove element and in the bottom end portion of the index finger glove element of the outer glove element and securing is performed by passing a fastening lace through these securing holes.

BRIEF DESCRIPTION OF THE DRAWINGS

FIG. 2 is a perspective view of the same baseball glove before the lace is threaded through;

DESCRIPTION OF THE PREFERRED EMBODIMENTS

Illustrative embodiments of the baseball glove and lining element according to the present embodiment will be explained below with reference to the figures.

Figure 1:
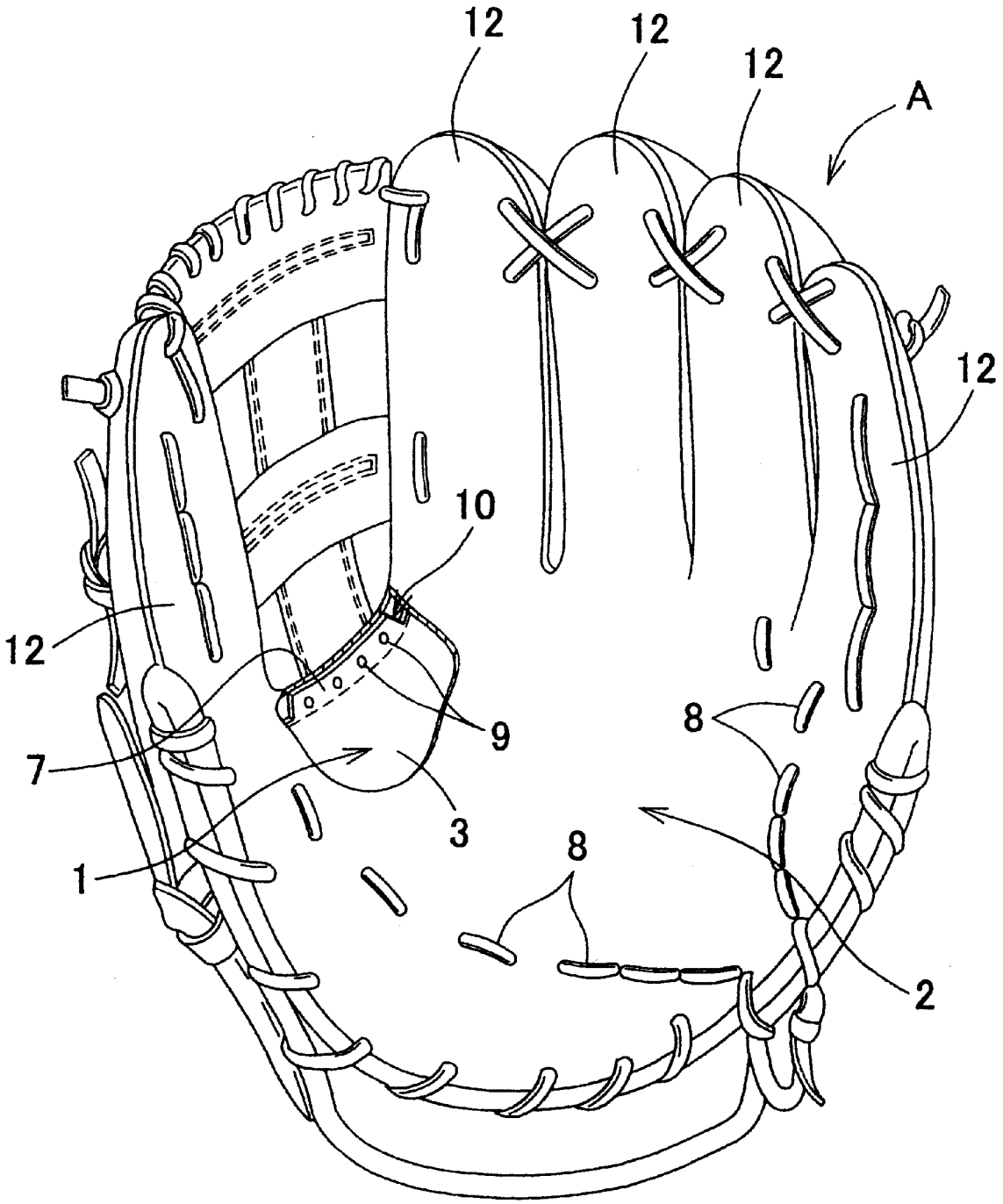
FIG. 1 is a partly sectional, perspective view of a first embodiment of the baseball glove.
Figure 2:
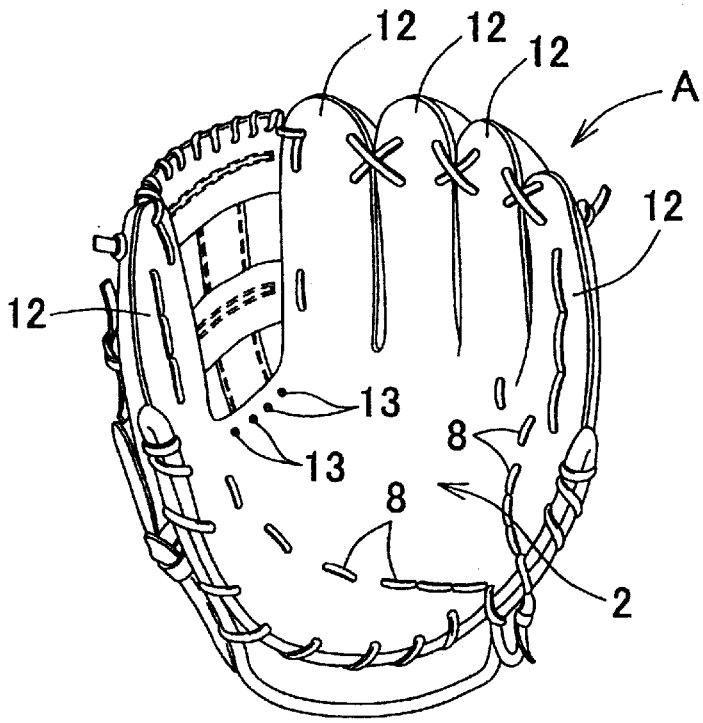
Figure 3:
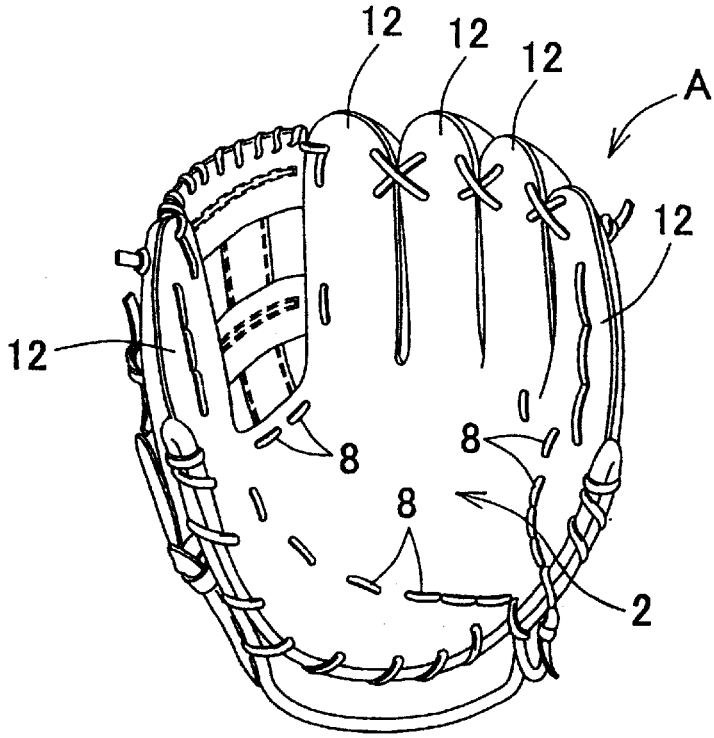
FIG. 3 is a perspective view of the same baseball glove.
Figure 4:
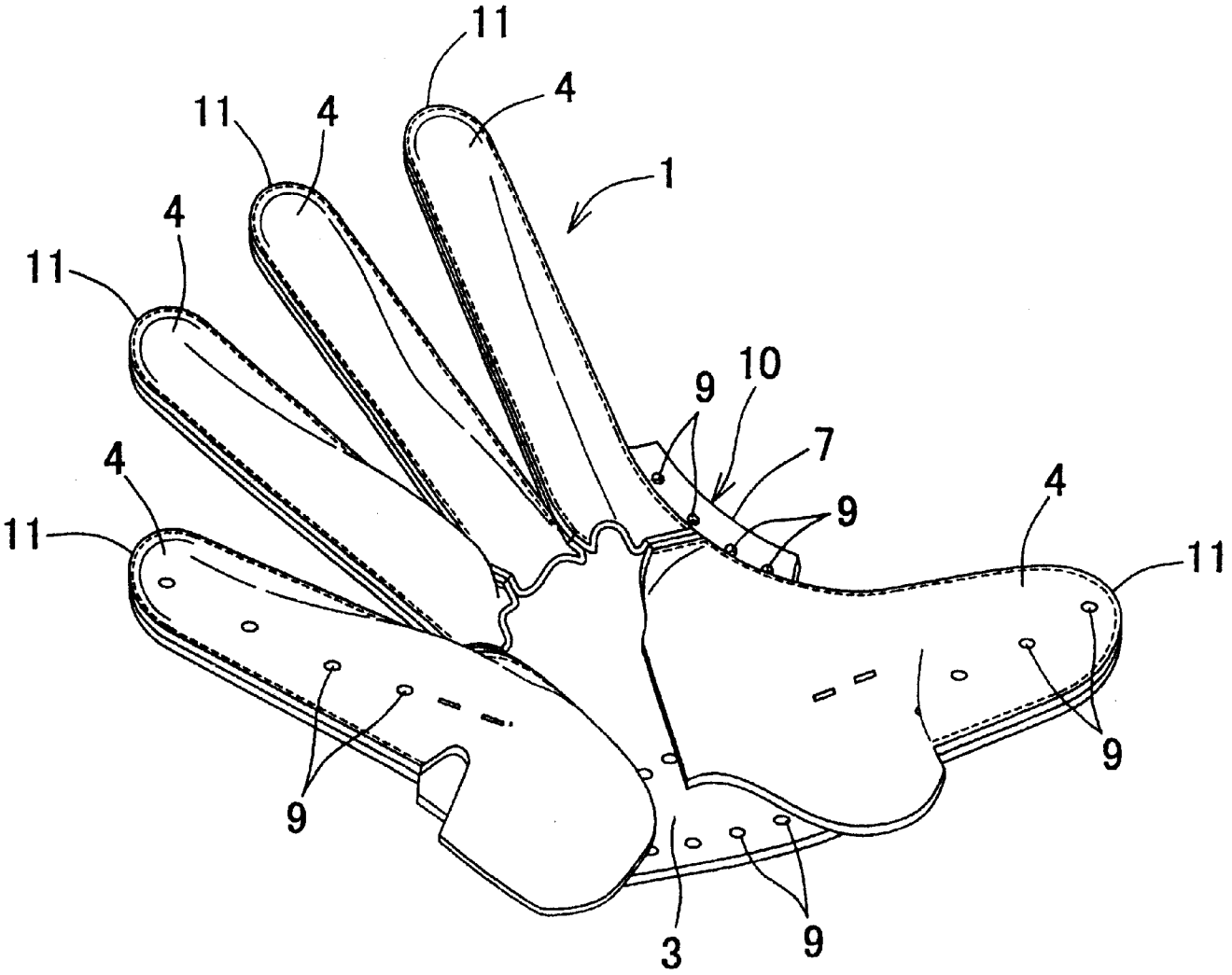
FIG. 4 is a perspective view of the lining element according to the first embodiment.
Figure 5:
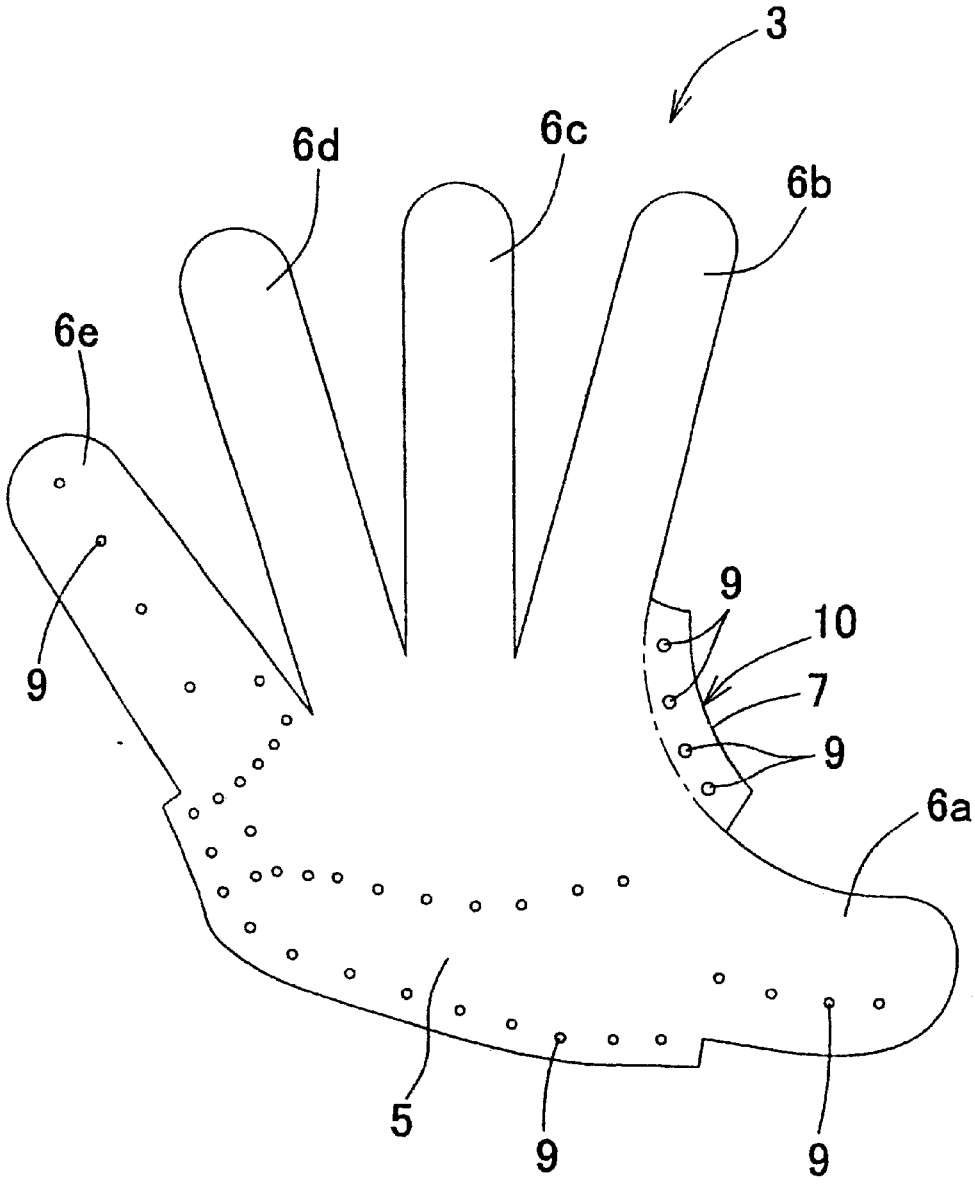
FIG. 5 is a front view of the front sheet of the lining element according to the first embodiment.

FIG. 1 is a partly sectional, perspective view, FIG. 2 is a perspective view of the same baseball glove before the lace is threaded through, FIG. 3 is a perspective view of the same baseball glove, FIG. 4 is a perspective view of the lining element according to a first embodiment, and FIG. 5 is a front view of the front sheet of the lining element according to the first embodiment.

The baseball glove A according to a first embodiment is, as shown in FIG. 1, constituted from a lining element 1 and an outer glove element 2, and, as shown in FIG. 4, the lining element 1 is constituted from a front sheet 3 and a back sheet 4. These are all formed from leather or synthetic leather or other materials such as fabric or the like.

Figure 6:
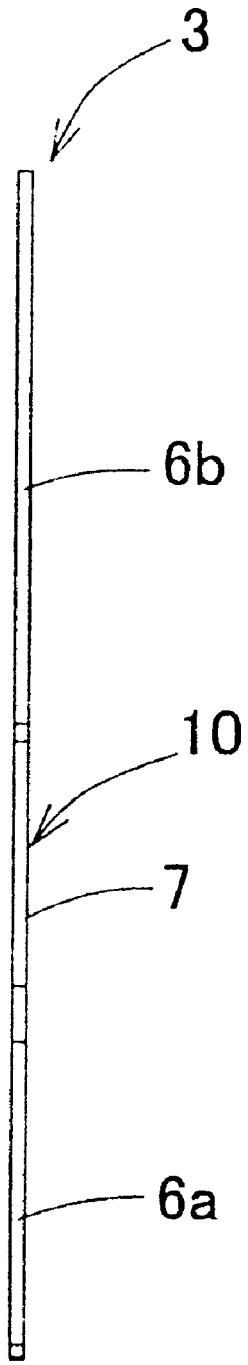
FIG. 6 is a side view of the same front sheet.

As shown in FIGS. 5 and 6, the front sheet 3 is in the shape of a hand, and the thumb part 6*a*, the index finger part 6*b*, the middle finger part 6*c*, the ring finger part 6*d* and the little finger 6*e* are provided so as to extend from the bottom end portion, and an elongated securing strap 7 projects outwards from edge of the bottom end (the edge indicated by dot dash lines in FIG. 5) between the thumb part 6*a* and the index finger part 6*b* thus forming a fitting part 10 by providing in the securing part through-holes 9 for passing through a lace 8. Apart from this, through-holes 9 for passing through a lace 8 are also provided in the thumb part 6*a*, small finger part 6*e* and bottom end 5 in the front sheet 3.

In the front sheet 3 as shown in FIG. 5, a single elongated securing part 7 projects and through-holes 9 are provided therein, but it is also possible to provide a plurality of projecting securing parts 7 with through-holes 9.

Furthermore, in the lining element 1, as shown in FIG. 4, the respective finger glove elements are formed by positioning the back sheets 4 which have the same shape as the finger parts of the front sheet on the back of the respective finger parts of the front sheet 3, laying them one on top of the other, aligning them and stitching them together.

The assembly of the baseball glove A is performed by inserting the finger glove elements 11 of the lining element 1 inside the respective glove finger elements of the outer glove element 2, and passing the lace 8 through the through-holes 12 in the outer glove element 2 and the through-holes 9 in the lining element 1. In this case, in particular, as shown in FIG. 2 and FIG. 3, the baseball glove can be assembled with the outer glove element 2 being in close contact with the lining element 1 at the ball catching surface of the baseball glove A by placing in a congruent position the through-holes 9 provided in the securing part 7 of the lining element 1 and the through-holes 13 provided in a matching position in the outer glove element 2 and incorporating said lining element 1 into said outer glove element 2 by threading through the lace 8.

In this way, in the baseball glove A and the lining element 1 according to the first embodiment, because the baseball glove can be assembled with the outer glove element 2 being in close contact with the lining element 1 at the ball catching surface of the baseball glove A by placing in a congruent position the through-holes 9 provided in the securing part 7 of the lining element 1 and the through-holes 13 provided in the outer glove element 2 and threading through the lace 8, the adhesion between the outer glove element 2 and the lining element 1 at the ball catching surface can be maintained even if the glove is subjected, for example, to heavy use, and the pocket of the ball catching surface does not become stretched nor does the glove lose its shape so that it continues to be easy to catch ball with the glove indefinitely.

Furthermore, because the lining element 1 according to the first embodiment, is constituted, as shown in FIG. 3, in such a way that the securing part 7 is formed so that it projects outward from the edge of the bottom end between the thumb part 6*a* and index finger part 6*b* on the front sheet 3, it is possible to form the front sheet 3 having the securing part 7 in one piece which makes manufacture easier.

Figure 7:
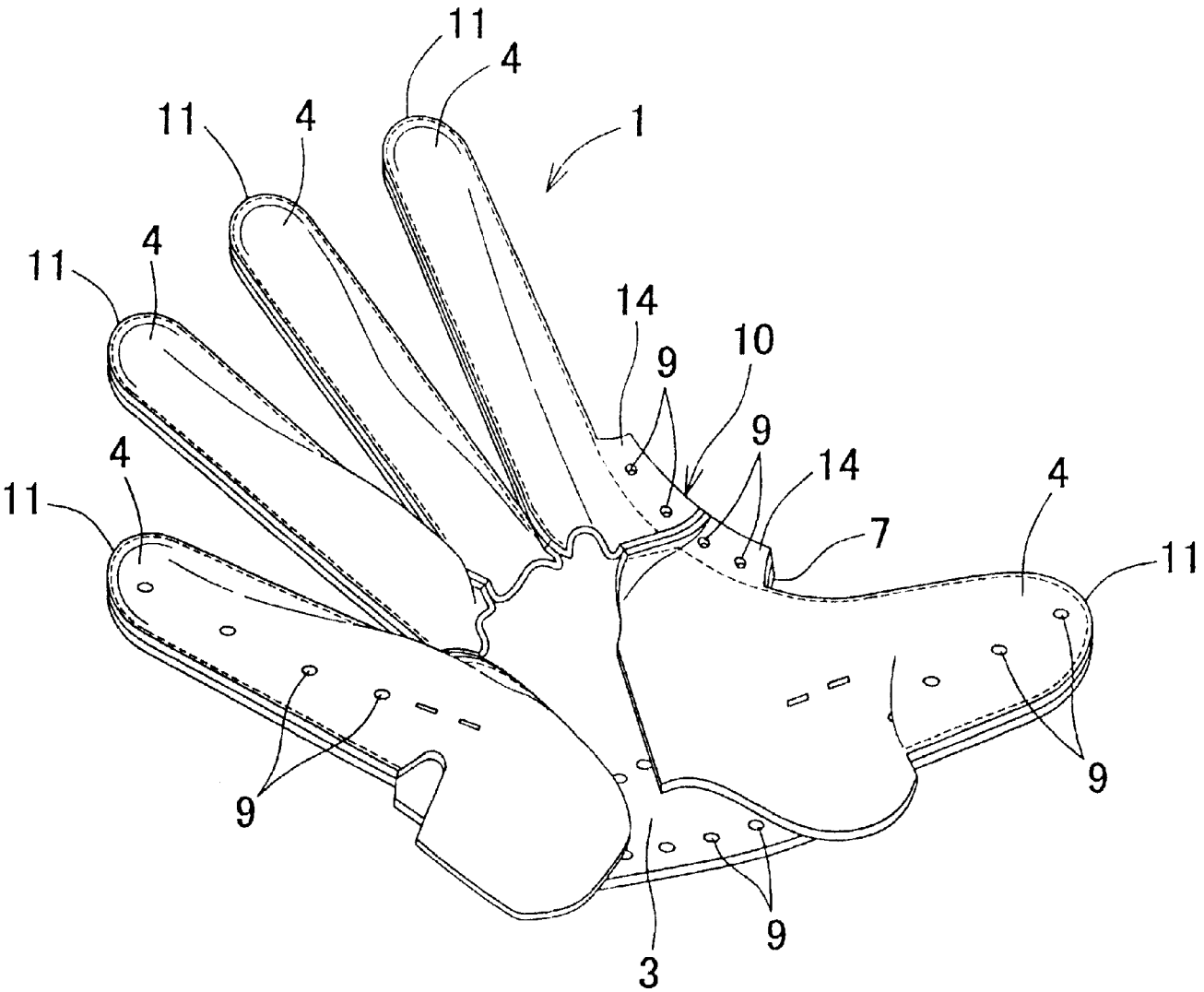
FIG. 7 is a perspective view of a lining element according to a second embodiment.

The lining element 1 according to the second embodiment is constituted, as shown in FIG. 7, from a front sheet 3 and the back sheet 4 and, in the same way as in the lining element 1 in the first embodiment, the front sheet 3 is provided with finger parts 6 each of which extends from the bottom end portion 5, and with a securing part 7 which projects outward from the edge of the bottom end between the thumb part 6*a* and the index finger part 6*b* and holes 9 are formed therein for passing through the lace 8. Matching this shape of the securing part 7, a second securing part 14 is provided extending from the edge of the end of the thumb back sheet 4 and index finger back sheet 4, and the second securing part 14 and the securing part 7 of the front sheet 3 are positioned one on top of the other and stitched together, and a fitting portion 10 is formed by providing through-holes 9 in the same way.

In this way, because a fitting portion 10 is formed in the lining element 1 according to the second embodiment by positioning the securing part 7 of the front sheet 3 and the second securing part 14 of the front sheet 4 one on top of the other and stitching them together, this lining element 1 according to the second embodiment has excellent strength compared to the lining element 1 according to the first embodiment.

Figure 8:
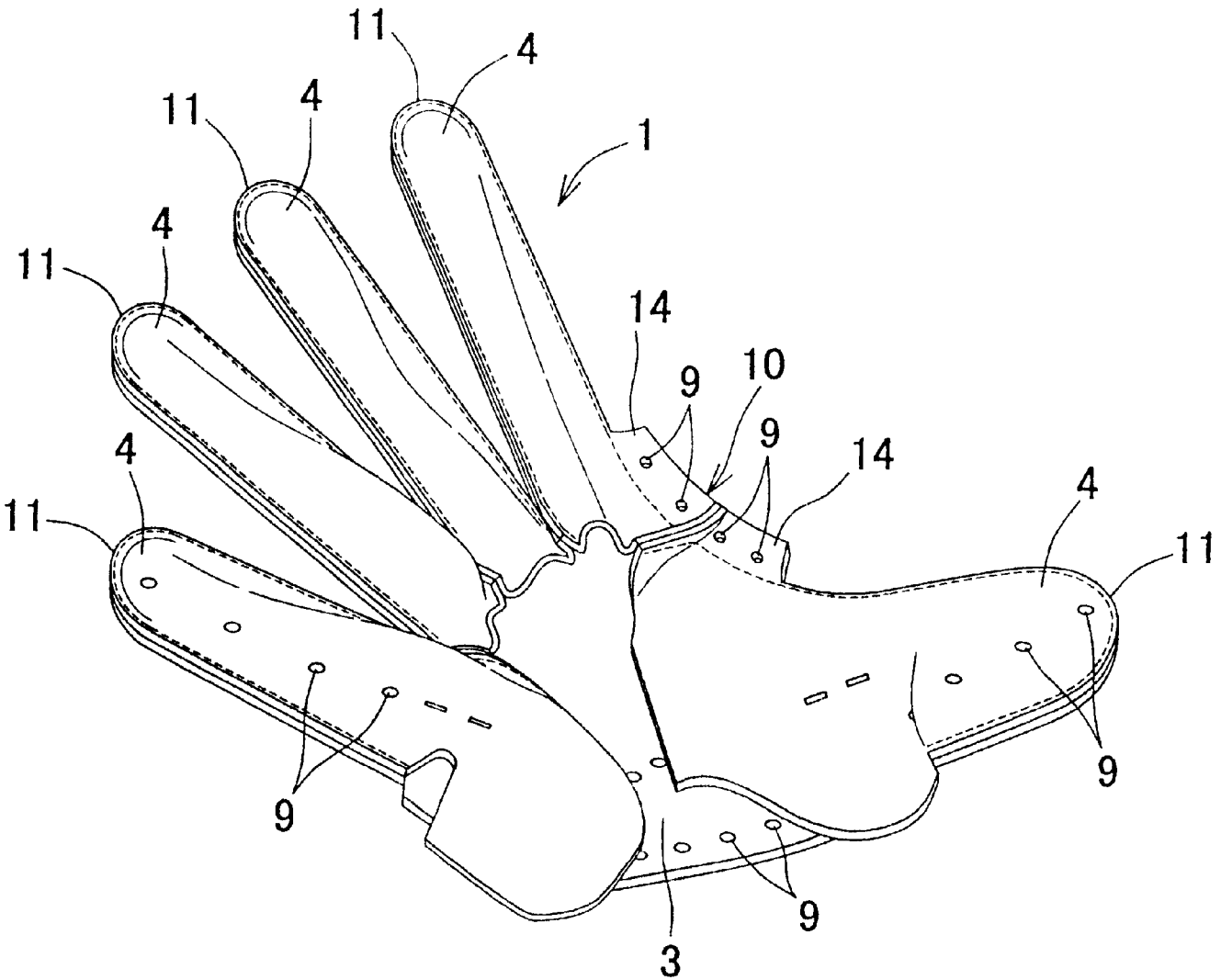
FIG. 8 is a perspective view of a lining element according to a third embodiment.
Figure 9:
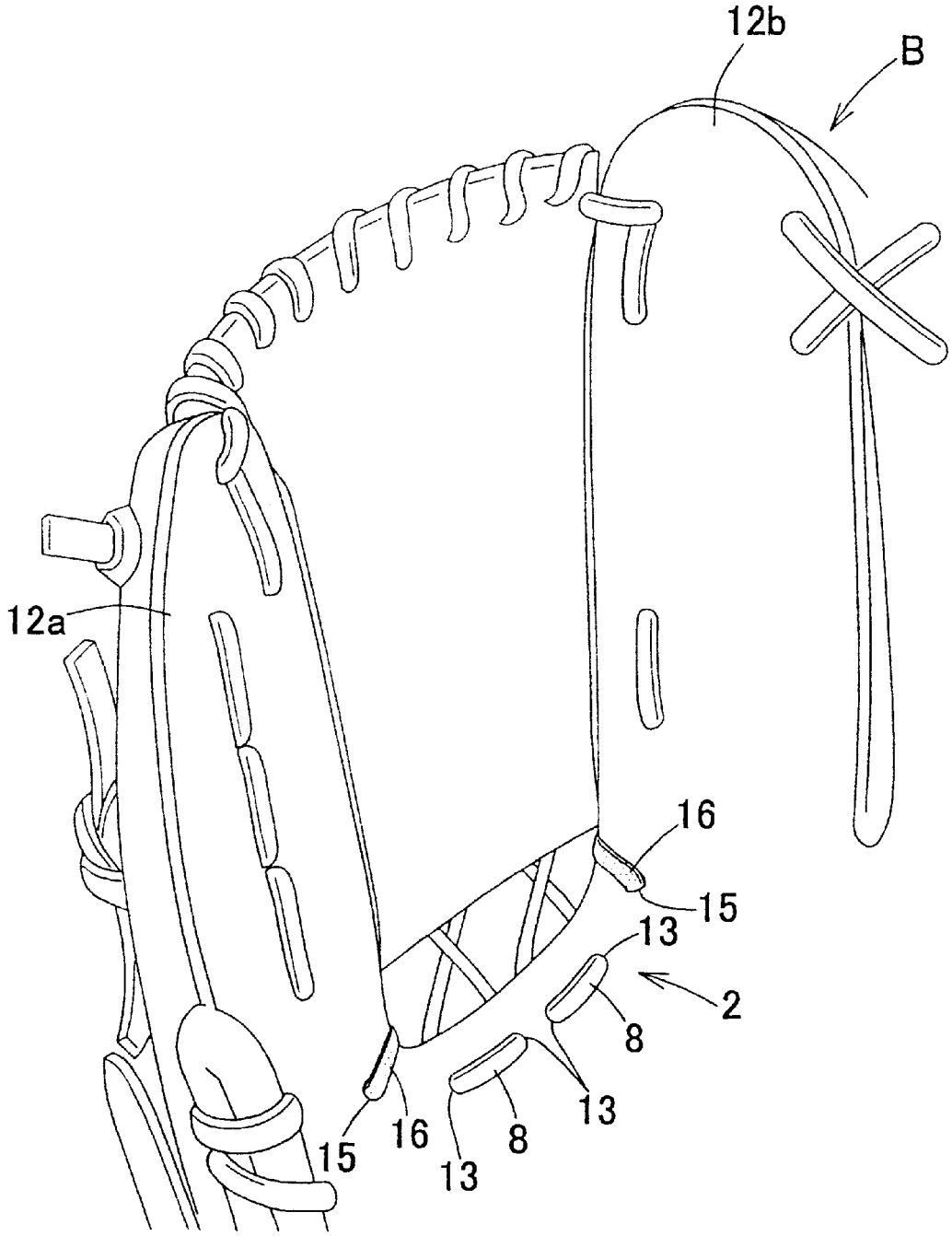
FIG. 9 is a magnified front view of the main parts of the baseball glove according to the second embodiment.
Figure 10:
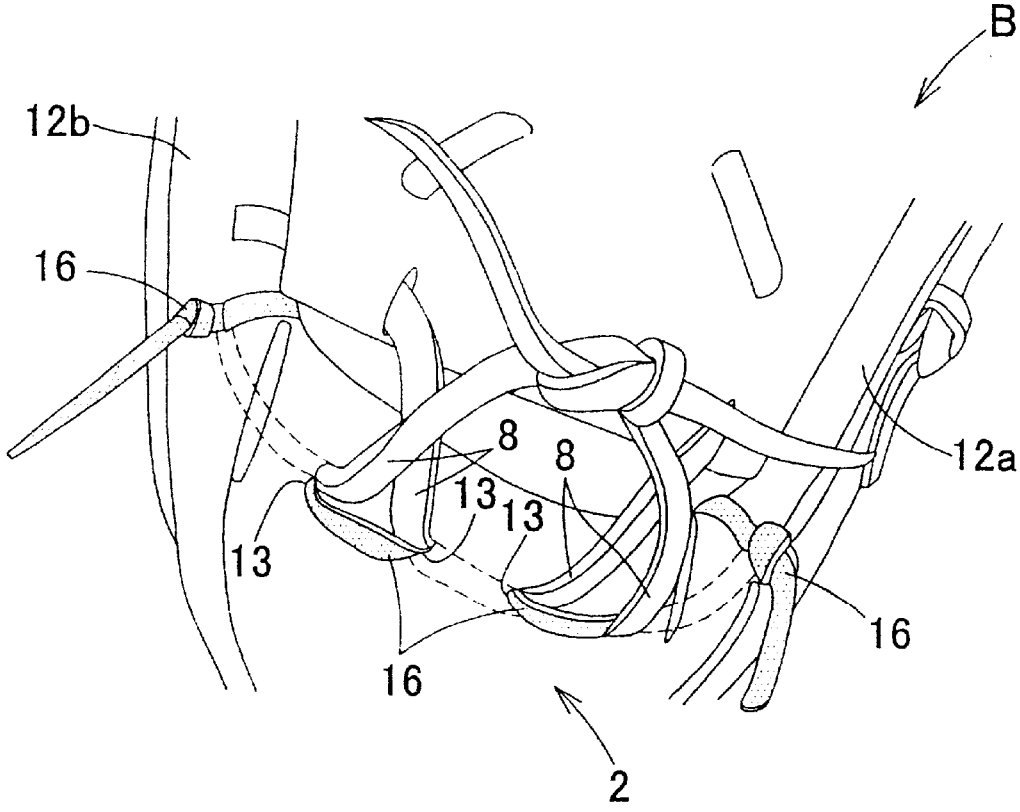
FIG. 10 is a magnified rear view of the main parts of the same baseball glove.

The lining element 1 according to the third embodiment is, as shown in FIG. 8, constituted, in the same way as the lining element 1 according to the second embodiment, from a front sheet 3 and back sheet 4 but the securing part 7 formed in the front sheet 3 is, in particular, not provided, and the fitting portion 10 is formed by providing a second securing part 14 so as to extend from the thumb back sheet 4 and the index finger back sheet 4 which have been joined together and by providing through-holes 9 therein.

Next, the other embodiments of the baseball glove will be explained.

Figure 11:
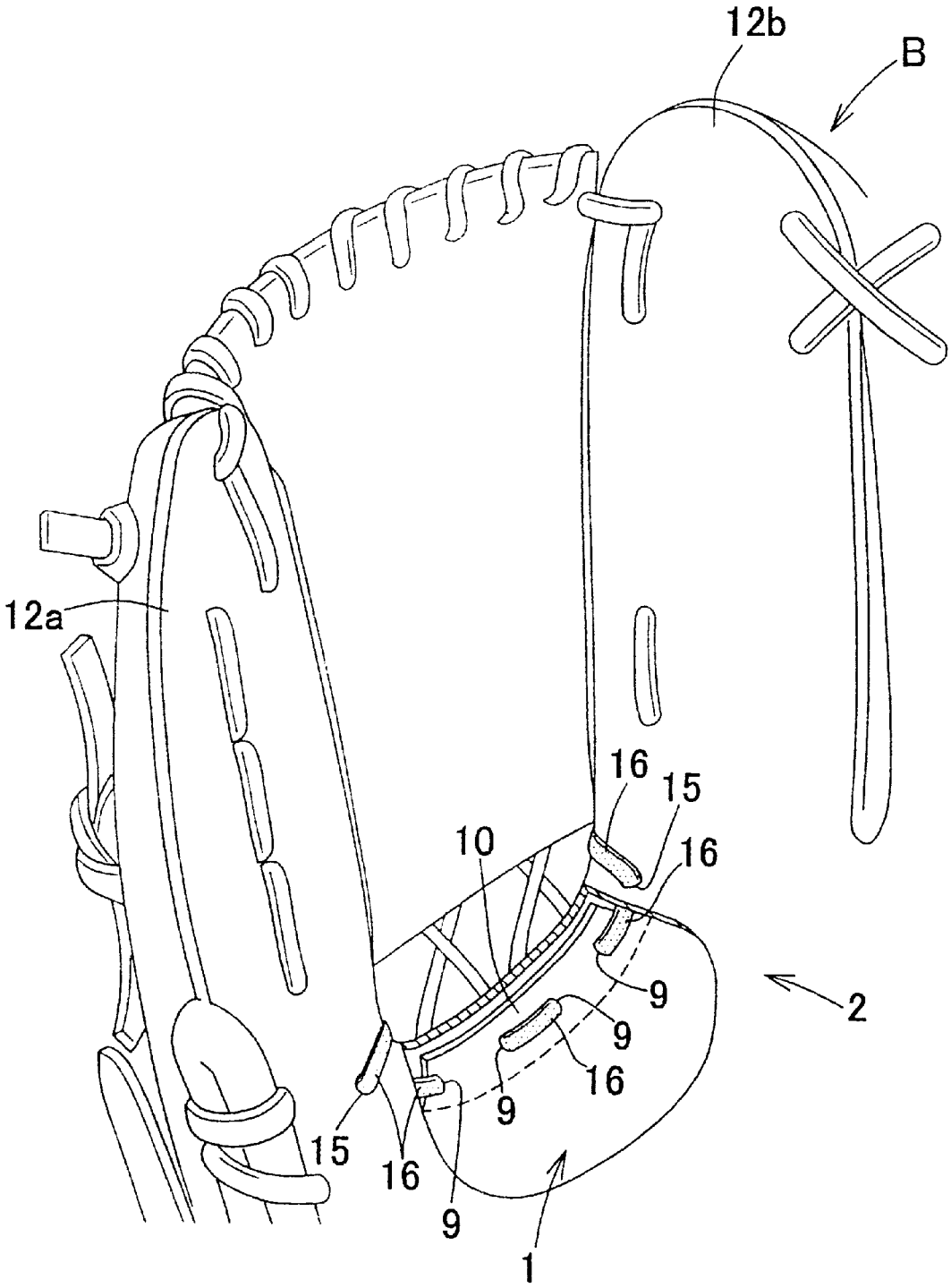
FIG. 11 is a partly sectional magnified front view of the main parts of the same baseball glove.
Figure 12:
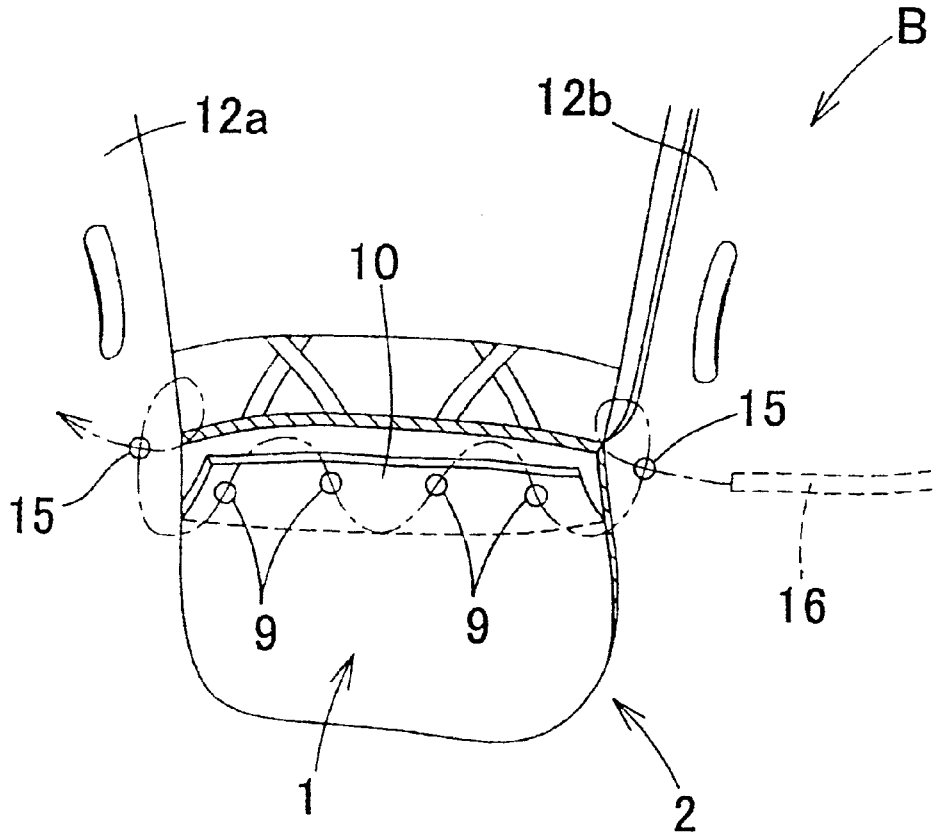
FIG. 12 is a magnified explanatory view of the main parts showing how the fastening lace is threaded through in the same baseball glove.

Firstly, in the baseball glove B according to the second embodiment shown in FIGS. 9 to 12, securing through-holes 15 are respectively provided which penetrate the bottom end portion of the thumb element 12*a* and the bottom end portion of the index finger element 12*b* of the outer glove element 2. In other words, as shown in FIG. 12, they penetrate the bottom end portions of the thumb elements 12*a* and of the index finger elements 12*b* from the front side to the back side. In particular on the sides of the finger elements 12*a* and 12*b* they face each other, and in said baseball glove a different fastening lace 16 is used from the lace 6 for assembling the glove, and, as shown in FIG. 11, the fastening lace 16 is fastened by lacing the same through through-holes 15, 15 and in four through-holes 9 in the fitting portion 10 in the lining element 1 which are positioned between said securing through-holes 15, 15, in such a way that the fastening laces 16 are positioned alternately on the front side of the lining element 1 and on the back side of the outer glove element 2, and by winding the opposite ends of the fastening laces 16 into the securing through-holes 15 and tying them. Furthermore, the baseball glove B according to the second embodiment is assembled by passing a lace 8 through the through-holes 13 of the outer glove element 2 after the fastening lace 16 has been fastened in this way. In the baseball glove, in this way, because the bottom end portion of the thumb element 12*a* of the outer glove element 2 and the bottom end portion of the index finger element 12*b* of the outer glove element 2 are secured with the front face and back face being in close contact with each other, it is possible to prevent the bottom end portion of the thumb element 12*a* and that of the index finger element 12*b* from tearing due to the impact when a ball is caught. In addition, the assembled glove is more stable because the lace 16 is threaded between the front face and the back face through securing through-holes 15 and through four through-holes 9 in the fitting portion 10 of the lining element 1 which are positioned between the securing through-holes 15.

Figure 13:
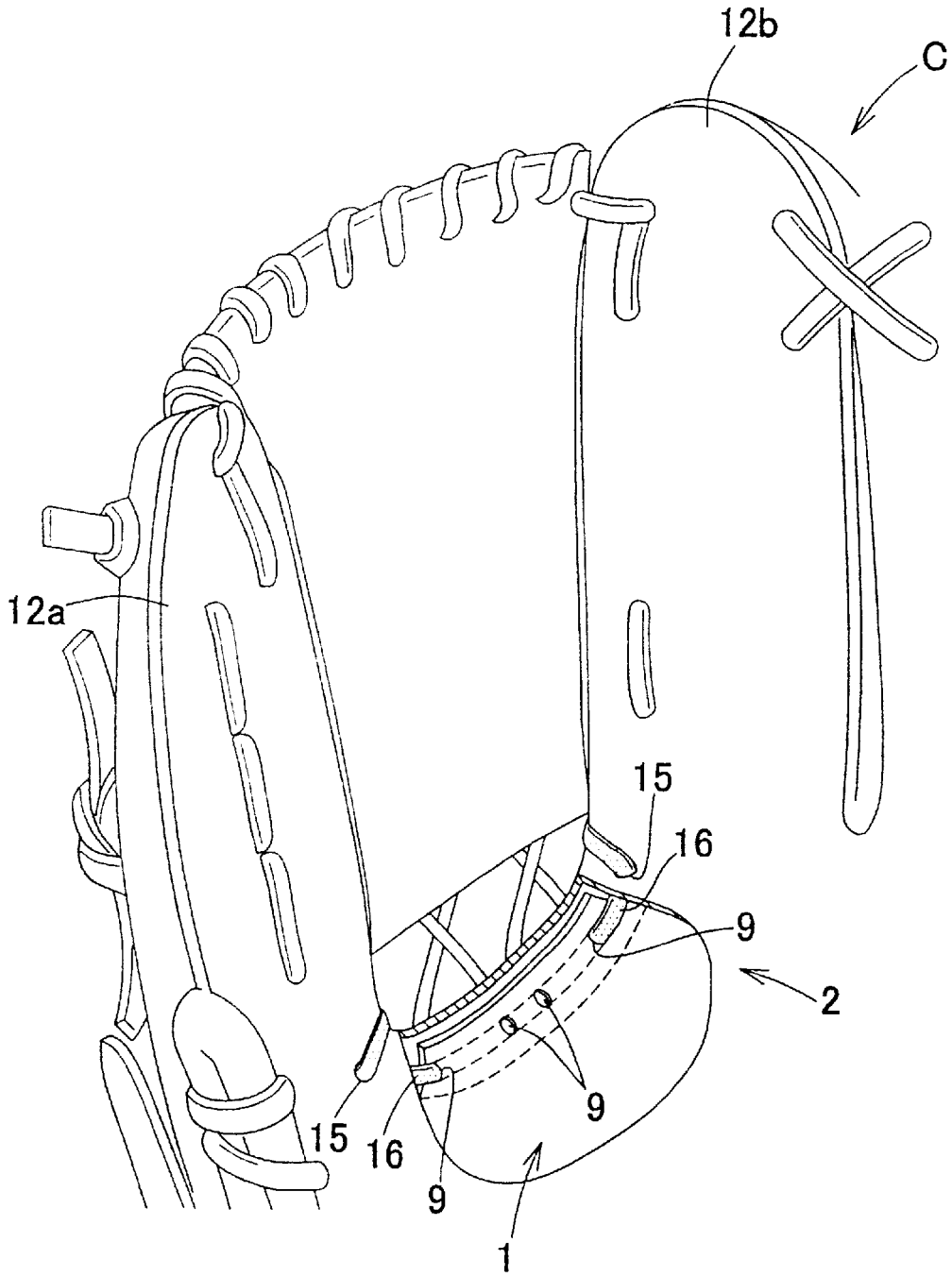
FIG. 13 is a partly sectional magnified front view of the baseball glove according to the third embodiment.
Figure 14:
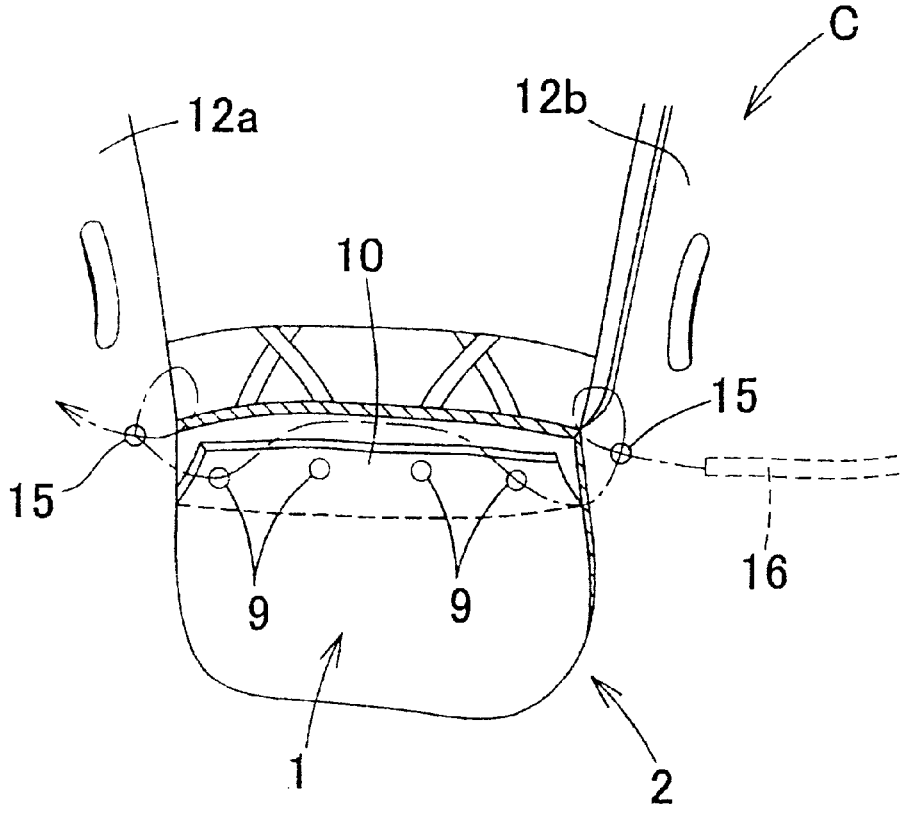
FIG. 14 is a magnified explanatory view of the main parts showing how the fastening lace is threaded through in the same baseball glove.
Figure 15:
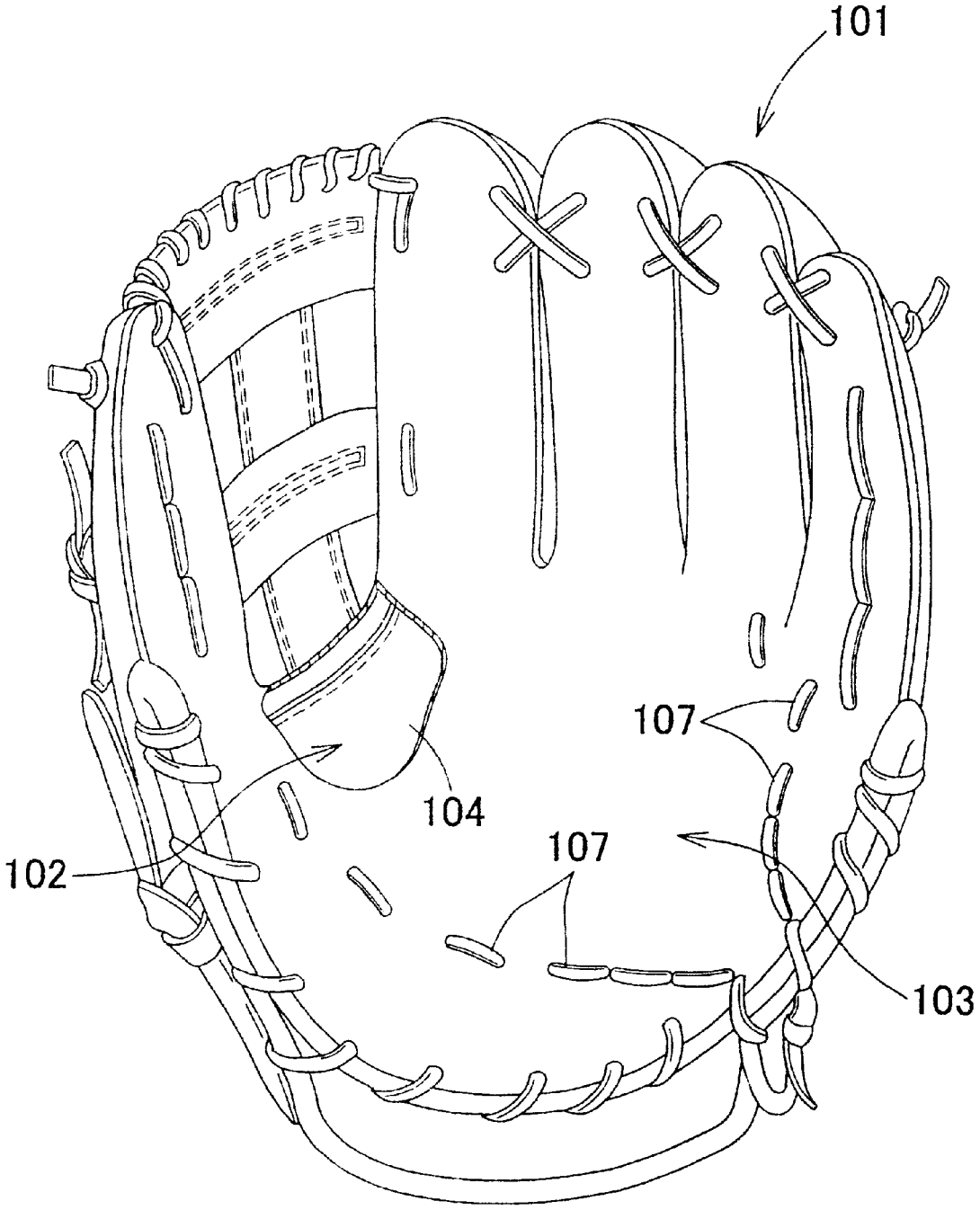
Fig. 15 PRIOR ART
FIG. 15 is a partly sectional, perspective view of a conventional baseball glove.
Figure 16:
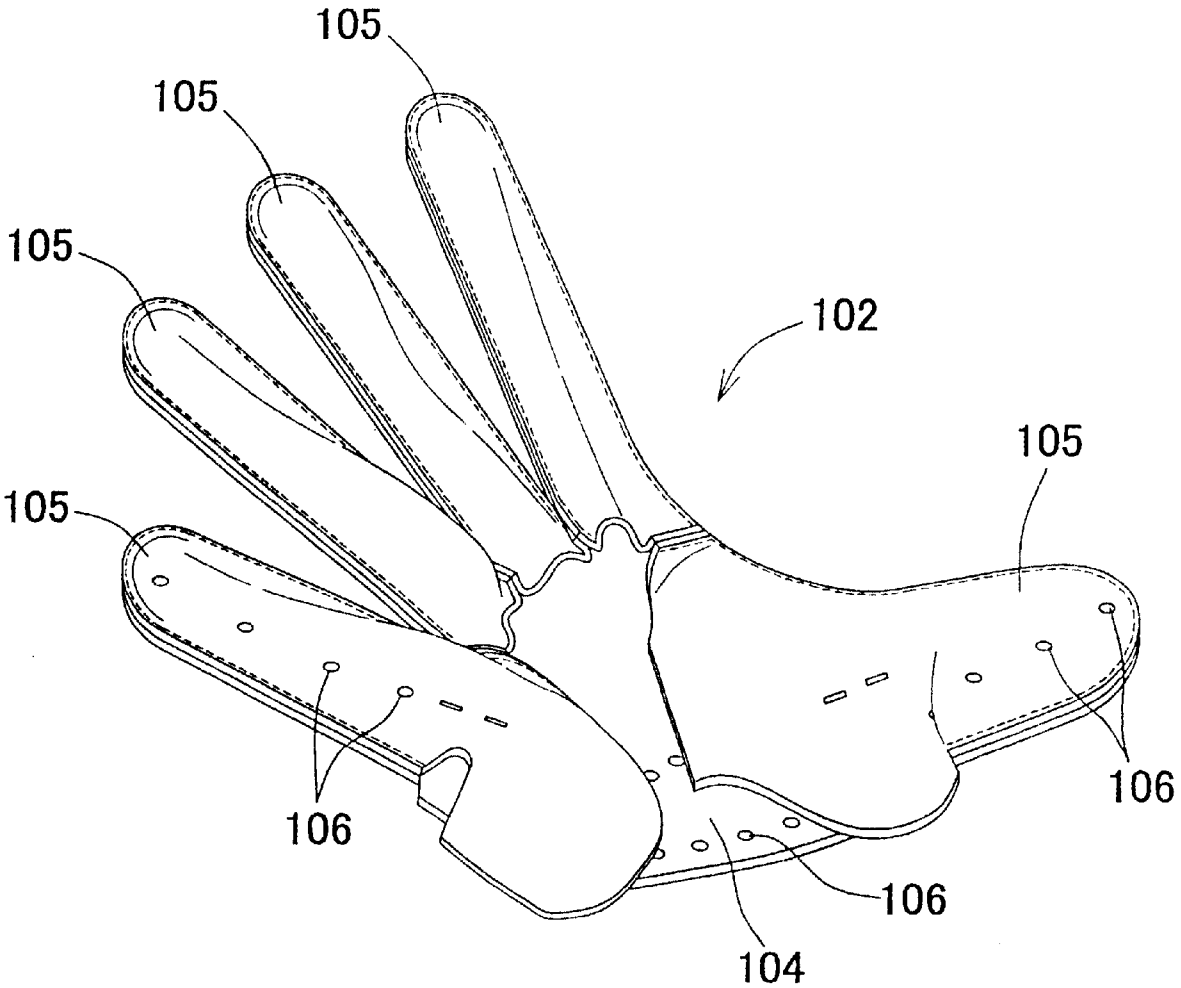
Fig. 16 PRIOR ART
FIG. 16 is a perspective view of a conventional lining element.

The method of passing through the fastening lace 16 is not restricted to the fastening method of the fastening lace 16 in the baseball glove B according to the second embodiment mentioned above. In the baseball glove C according to the third embodiment shown in FIGS. 13 and 14 the fastening lace 16 is wound through only the securing through-holes 15 and 15 and through-holes 9 on the opposite sides of the fitting portion 10 of the lining element 1 positioned between said securing through-holes 15 and 15 without passing said fastening lace 16 through the two through-holes 9 which are positioned in the central portion but placed between the fitting portion 10 of the lining element 1 and the outer glove element 2.

In addition, in the baseball glove B according to the second embodiment and the baseball glove C according to the third embodiment mentioned above, one fastening lace 16 is used but it is also possible to fasten [said baseball glove] using two fastening laces 16 which are respectively wound through the bottom end portion of the thumb element 12*a* and the bottom end portion of the index finger portion 12*b*.

In the baseball glove B mentioned above, one securing through-hole 15 is respectively provided in the bottom end portion of the thumb element 12*a* of the outer glove element and in the bottom end portion of the index finger element of the outer glove element but 2 or more may be respectively provided.

As stated above, in the lining element and baseball glove according to the present invention, the baseball glove can be assembled with the outer glove element being in close contact with the lining element at the ball catching surface of the baseball glove by placing the through-hole in the fitting portion in the lining element and the through-hole in the outer glove element in a congruent position and incorporating said lining element into said outer glove element by passing through a lace, so that, for example, even if the glove is subjected to heavy use, the pocket of the ball catching surface does not become stretched nor does the glove lose its shape so that it is continues to be easy to catch with the glove indefinitely.

In the lining element and baseball glove according to the present invention, the securing part is constituted projecting outward from the edge of the bottom end between the thumb part and index finger part on the front sheet so that it is possible to form the front sheet having the securing part in one piece, which makes the manufacture easier.

In the baseball glove according to the present invention, the front and back faces of the bottom end portion of the thumb element and those of the bottom end portion of the index finger element of the outer glove element can be secured in close contact with each other, so that it is possible to prevent the bottom end portions of the thumb element and index finger element from tearing due to the impact when a ball is caught.

What is claimed is:

1. A baseball glove lining element, which is hand-shaped having thumb and finger elements and comprises a front sheet to which finger parts are provided so as to extend from a bottom end portion, and a back sheet which is positioned on a back of the respective finger parts of the front sheet and forms glove finger elements, wherein a fitting portion extension is formed by a securing part which projects outward from an edge between the thumb and index finger parts in at least one of the sheets forming the lining element, said securing part having through-holes for passing through a lace for attaching said securing part between thumb and index finger elements of an outer element of a baseball glove.

2. The lining element of a baseball glove according to claim 1, wherein the fitting portion extension is formed by providing said securing part which projects outward from an edge of the bottom end between the thumb and index finger parts of the front sheet and by providing the through-holes for passing through a lace in the securing part.

3. The lining element of a baseball glove according to claim 1, wherein said securing part is provided by extending part of the back sheet positioned on the back of the thumb and index finger parts of the front sheet so as to project outward from the edge of the bottom end between the thumb and index finger parts of said front sheet, and the fitting portion extension is formed by providing in this securing part through-holes for passing through a lace.

4. A baseball glove, wherein a lining element which is hand-shaped having thumb and finger elements is used, said lining element comprising; a front sheet in which finger parts are provided so as to extend from a bottom end portion; a back sheet which is positioned on a back of the respective finger parts of the front sheet and forms the glove finger elements; a fitting portion extension is formed by a securing part which projects outward from an edge between the thumb and index finger parts of at least of one of the sheets forming the lining element, said securing part having through-holes for passing through a lace is provided between the thumb element and an index finger element of said lining element; and wherein, in order to assemble the baseball glove by inserting and incorporating said lining element into the outer glove element, and passing a lace from the outer glove element to the lining element, the lace is also passed through the through-holes in said securing part of said lining element.

5. A baseball glove wherein a lining element is used according to claim 4, in which said securing part is provided projecting outward from said edge of the bottom end between the thumb and the index finger parts of the front sheet, and said securing part of said fitting portion extension is formed with through-holes for passing through the lace.

6. The baseball glove wherein a lining element is used according to claim 4, in which said securing part is provided by extending part of the back sheet positioned on the back of the index finger and thumb parts of the front sheet so as to project outward from an edge of the bottom end portion between the thumb and index finger parts of the front sheet, and said fitting portion extension is formed by providing in said securing part through-holes for passing through a lace.

7. The baseball glove according to any one of claim 4, 5 or 6, wherein securing through-holes which penetrate a front surface side and a back surface side of an outer glove element are provided in the bottom end portion of the thumb element and in the bottom end portion of the index finger element of the outer glove element, so that the lace is fastened by passing through these securing holes.

* * * * *